US005240502A

United States Patent [19]

Castaldo et al.

[11] Patent Number: 5,240,502

[45] Date of Patent: Aug. 31, 1993

[54] IMPROVEMENT IN APPARATUS FOR APPLYING A COATING TO A MOVING SURFACE

[75] Inventors: Roger E. Castaldo, Alsip; Samuel B. Allen, Orland Hills; Thomas J. Bauer, Orland Park, all of Ill.

[73] Assignee: Mactron, Inc., Alsip, Ill.

[21] Appl. No.: 611,520

[22] Filed: Nov. 13, 1990

[51] Int. Cl.[5] ..... B05C 5/02

[52] U.S. Cl. ..... 118/302; 118/678; 222/108; 222/402.12; 222/571; 239/114; 239/115

[58] Field of Search ..... 118/302, 669, 677, 678; 239/114, 106, 115; 222/108, 571, 402.12

[56] References Cited

U.S. PATENT DOCUMENTS

| | | | |
|---|---|---|---|
| 466,633 | 1/1892 | Stevens | 239/114 X |
| 2,899,929 | 8/1959 | Monroe | 118/302 |
| 4,259,372 | 3/1981 | Eddy | 118/302 X |
| 4,387,002 | 6/1983 | Knecht | 118/302 X |
| 4,408,562 | 10/1983 | DeCamp et al. | 118/669 |
| 4,416,213 | 11/1983 | Sakiya | 118/302 X |
| 4,461,404 | 7/1984 | Baughman et al. | 118/302 X |
| 4,517,917 | 5/1985 | Santefort | 118/677 X |
| 4,527,510 | 7/1985 | Arndt | 118/669 |
| 5,065,692 | 11/1991 | Hollesen et al. | 239/114 X |

FOREIGN PATENT DOCUMENTS

| | | | |
|---|---|---|---|
| 9004733 | 8/1990 | Fed. Rep. of Germany . | |
| 3908453 | 9/1990 | Fed. Rep. of Germany | 239/115 |

*Primary Examiner*—Richard L. Chiesa

*Attorney, Agent, or Firm*—Trexler, Bushnell, Giangiorgi & Blackstone, Ltd.

[57] ABSTRACT

An improvement is provided in a coating system including a dispenser, a coating outlet for delivering a coating material to a surface of a moving workpiece to which coating is to be applied in a desired pattern, and a dispensing control for producing control signals in a predetermined fashion for initiating and terminating the release of coating material to the outlet. The improvement includes a wiping member selectively advanceable and retractable relative to the coating outlet for wiping excess coating material therefrom and a cleaning control responsive to predetermined control signals from the dispensing control for advancing and retracting the wiping member in a predetermined fashion.

9 Claims, 4 Drawing Sheets

34
30
40
84
41
96
94
86
88
92
90
32
36
34
39
38
20

IMPROVEMENT IN APPARATUS FOR APPLYING A COATING TO A MOVING SURFACE

BACKGROUND OF THE INVENTION

The present invention is directed generally to the coating arts, and more particularly to a novel and improved non-contact coating apparatus for applying a coating to a moving surface.

While the invention may find utility in other applications, the disclosure will be facilitated by specific reference to the problem of application of a liquid glue medium in a desired pattern to a moving substrate such as a paper carton. In the manufacture of folded paper cartons and the like it is desirable to apply lines or beads of glue to predetermined surfaces of the folded carton and in predetermined patterns for use in later erecting and assembling the carton.

In non-contact gluing methods, a controllable extruding applicator or glue-dispensing mechanism is utilized, spaced some distance above the surface of the moving carton or other workpiece on which glue is to be applied in a desired pattern. Generally speaking, such a pattern comprises one or more relatively straight lines of glue of predetermined length. Multiple lines of glue may, of course, be applied by the use of multiple nozzles or glue dispensers aligned with appropriate portions of the workpiece or carton surface. Non-contact extrusion gluing systems of this type are discussed in prior U.S. Pat. Nos. 4,408,562 and 4,527,510, both commonly owned with this application, and to which further reference is invited.

While the non-contact extrusion gluing systems of the above-referenced U.S. patents have proven highly reliable in operation, there is room for further improvement. More specifically, in some high-volume, high-speed gluing systems, some build-up of glue on and about the nozzle or outlet of the dispenser or applicator member has been experienced. While this may be corrected by physical wiping or cleaning by an operator, it is quite difficult to correct this condition while the gluing system is in operation. At the relatively high speeds at which most systems are operated, it is quite difficult for an operator to physically wipe or otherwise clean the dispensing applicator or nozzle without interfering with the relatively high speed dispensing of glue thereby. However, it is also undesirable to shut down a relatively high speed, and highly efficient gluing system and attendant article handling lines and equipment at frequent intervals to achieve such cleaning or wiping operations.

Similarly, when the gluing apparatus is turned off for some period of time, there is a tendency for glue residue in and about the outlet and outlet valve component to dry and harden. We therefore propose a system which will also cover the glue outlet when the system is shut down to prevent such drying and hardening.

OBJECTS AND SUMMARY OF THE INVENTION

Accordingly, it is a general object of this invention to provide a novel and improved coating dispensing system employing a novel automated wiping system for wiping excess coating material from a dispensing member in an automated sequence with the dispensing operation thereof, and without interfering with the normal dispensing operation thereof, and for preventing drying and hardening of glue residue in the outlet and nozzle during extended shut-down periods.

Briefly, and in accordance with foregoing objects, the present invention comprises an improvement in a coating dispensing system of the type having at least one coating outlet for delivering coating material to the surface of a moving workpiece to which coating is to be applied in a desired pattern and dispensing control means for producing control signals for initiating and terminating the release of coating material to said outlet in a predetermined controlled fashion. The improvement comprises outlet cleaning means including a wiping member selectively advanceable and retractable relative to said coating outlet for wiping excess coating material therefrom and cleaning control means responsive to said control signals from said dispensing control means for advancing and retracting said wiping member in a predetermined fashion.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawings in which like reference numerals identify like elements, and in which:

DETAILED DESCRIPTION OF THE PREFERRED EMBODIMENT

Figure 1:
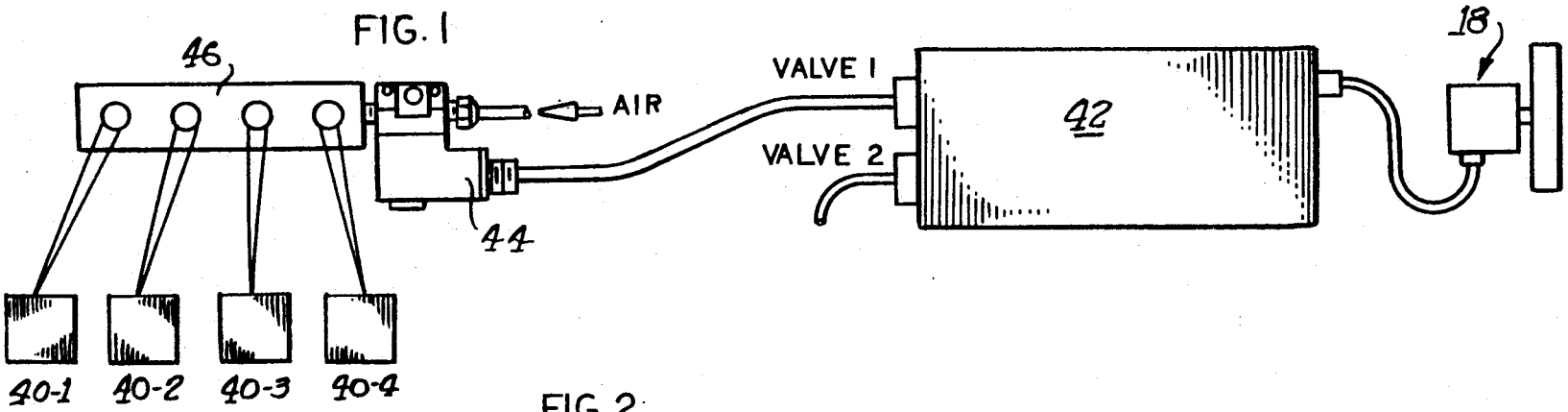
FIG. 1 is a diagrammatic view of a portion of a non-contact coating apparatus in which improvements in accordance with the invention are illustrated.
Figure 4:
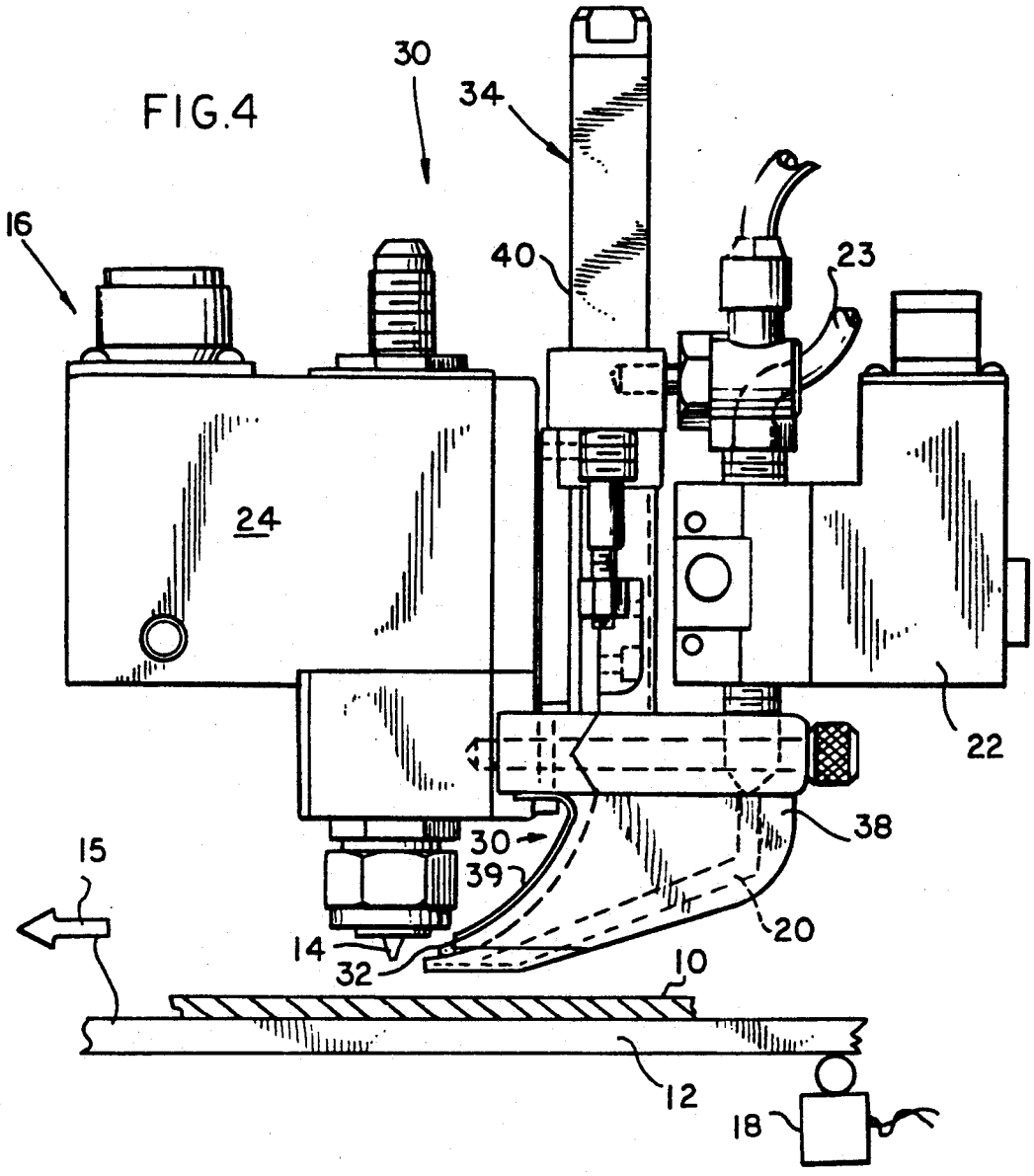
FIG. 4 is a side elevational view, partially broken away, of an improved apparatus in accordance with the invention.

Referring now to the drawings, and initially to FIGS. 1 and 4, there is illustrated an improvement in a non-contact system for applying a coating such as glue to a surface of a moving workpiece such as a folded paper carton. As illustrated somewhat schematically in FIG. 4, the paper carton or other workpiece 10 may be carried upon a conveyor belt 12 past a coating delivery nozzle tip or outlet 14 of a coating dispenser or dispensing apparatus designated generally by the reference numeral 16. As more fully described in the above-referenced U.S. patents, dispensing control means, including a tachometer-type pulse generator or generating means 18 and a controller 24, controls the flow of coating to outlet 14. The pulse generator 18 may take the form of a contact-type tachometer which contacts the conveyor belt 12 and generates pulses at a frequency proportional to the linear speed of the conveyor 12, and hence of the carton or other workpiece 10 carried thereupon past the outlet 14. Other means for generating such pulses may be used without departing from the invention.

As more fully described in above-referenced U.S. Pat. No. 4,408,562, tailing of the bead of glue or other coating dispensed from outlet 14 is substantially eliminated or minimized by the use of an air jet arrangement. This air jet arrangement includes a nozzle 20 which is placed for directing a short blast of air across the outlet 14 and generally intermediate the outlet and the surface of the workpiece 10, in a coordinated fashion with the termination of the dispensing of coating or glue at the outlet 14.

The air jet imparts a component of acceleration generally in the direction of travel 15 of conveyor 12 so as to substantially prevent or minimize the phenomena of glue-tailing which tends otherwise to occur with the dispensing of glue on a relatively rapidly moving workpiece 10. The nozzle 20 is coupled with a suitable air control valve 22 which is supplied at inlet 23 from a suitable source of compressed air (not shown). Further details of this arrangement are set forth in the above-referenced prior U.S. Pat. No. 4,408,562.

The controller 24 is operatively coupled for producing control signals in a predetermined fashion for initiating and terminating the release of coating material to the outlet 14. The controller operates in response to the pulses produced by the tachometer pulse generator 18 and includes suitable intervening control circuitry, an example of which is illustrated and described in the above-referenced prior U.S. patents.

In accordance with the invention, an additional outlet cleaning means or assembly generally designated by reference numeral 30 is also provided for cleaning or wiping the tip or outlet 14 in predetermined intervals during the dispensing or coating operations. In the illustrated embodiment, this outlet cleaning means 30 includes a wiping member 32 which is selectively advanceable and retractable relative to the outlet 14 for wiping excess coating material therefrom. As will be more fully described hereinbelow, cleaning control means 34 are responsive to predetermined control signals from the dispensing control means for advancing and retracting the wiping member 30 at predetermined times in relation to the dispensing of coating.

In the illustrated embodiment, the wiping member 30 preferably comprises an elongate flexible pad preferably made of felt and coated with a quantity of light machine oil or vegetable oil in order to prevent hardening of the glue upon the pad. We prefer to construct the felt pad of a felt material available from Spartan Felt Company of Roebuck, S.C. 29376, sold as felt type HP35. However, other suitable materials might be utilized without departing from the invention.

Figure 5:
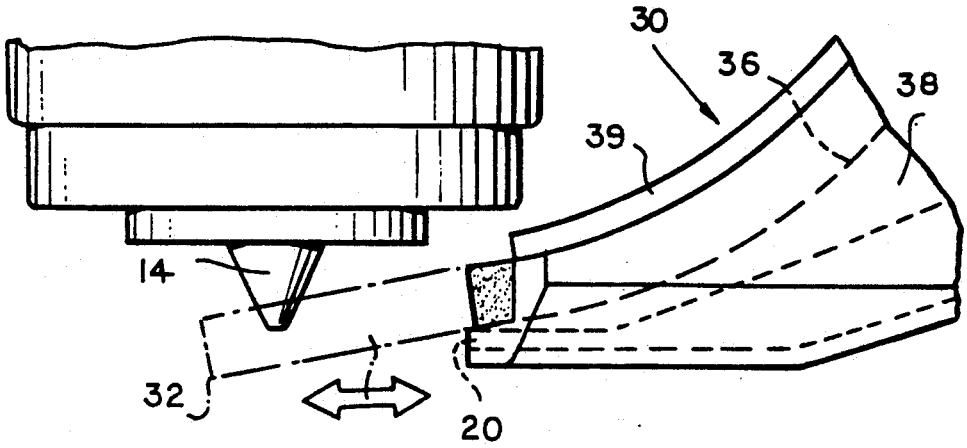
FIG. 5 is an enlarged partial elevational view of a dispensing nozzle and a wiper member in accordance with the present invention.

As best viewed in FIGS. 4 and 5, the elongate pad 32 is mounted in an elongate guide means or channel 36 formed in a mounting block or body 38. This body 38 may also be bored to form the air jet nozzle portion 20 described hereinabove. The channel or guide means is further defined by a guide bracket or strap 39 which is fitted over an open side of channel 36 to guide the felt pad 32 for sliding motion therebetween. With reference briefly to FIG. 5, the range of motion of the felt pad is between a first position illustrated in phantom line in FIG. 5 wherein the pad 32 is in contact with the coating outlet 14, and a second position illustrated in solid line in FIG. 5 wherein the pad is retracted from the coating outlet 14.

The control means for advancing and retracting the pad 32 includes a drive means or assembly which preferably takes the form of a fluid-operated and preferably an air-operated, spring-loaded cylinder 40. Control means 34 also include electronic control circuits indicated diagrammatically at reference numeral 42 in FIG. 1 and an air valve 44 also shown in FIG. 1, control the flow of air to the piston 40 for advancing and retracting the flexible pad 32. The spring-loaded cylinder is arranged to advance the wiper 32 to contact tip 14 in the absence of a supply of compressed air. Compressed air at inlet 41 will cause the cylinder 40 to retract the wiper 32. As illustrated in FIG. 1, the control circuit and related elements 42 may control more than one air valve such as air valve 44. Moreover, each air valve 44 is preferably coupled to a block or manifold 46 which is capable of controlling as many as four individual pistons and cylinders (40-1, 40-2, etc.) of the same type as piston and cylinder 40 of FIG. 4. Hence the system of the invention may be utilized in a system having a plurality of generally independently operated dispensing nozzles or outlets such as the outlet 14.

In the illustrated embodiment, the cleaning control means 34 and in particular the control elements or circuits 42 are responsive to the frequency of the pulse signals produced by tachometer 18 for actuating the wiping member 32 for advancing to wipe excess coating material from outlet 14 when this frequency crosses a predetermined threshold frequency. In the illustrated embodiment, the threshold frequency is selected to correspond to a predetermined relatively low speed of the conveyor 12, below which there is sufficient time to advance and retract the wiping member or wiper 32 safely, without interfering with the dispensing operation. In this regard, it will be remembered that the dispensing operation includes both the dispensing of a bead of glue from outlet 14 as well as the delivery of air from air jet or nozzle 20 at the end of each segment of dispensed glue or coating. However, the dispensing control circuit 24 is also responsive to a second predetermined threshold frequency of the tachometer pulse signal for preventing dispensing at the outlet 14. Selection of these two threshold frequencies is always coordinated so that the second or dispensing cutoff threshold frequency corresponds to a somewhat higher speed of the conveyor than the threshold frequency for wiper operation. Hence, the wiper does not normally operate while glue is being dispensed from the outlet 14.

Accordingly, in the event the conveyor is at a standstill or moving at a rate below the predetermined safe rate for wiping, the wiping pad 32 will be automatically advanced into contact with the dispensing outlet or tip 14 by the control circuit 42 of the invention. Hence, when the system is shut down, the pad 32 will be advanced and cover the outlet, thereby preventing drying and hardening of glue residue in the outlet and in and about the adjacent valve components.

Figure 2:
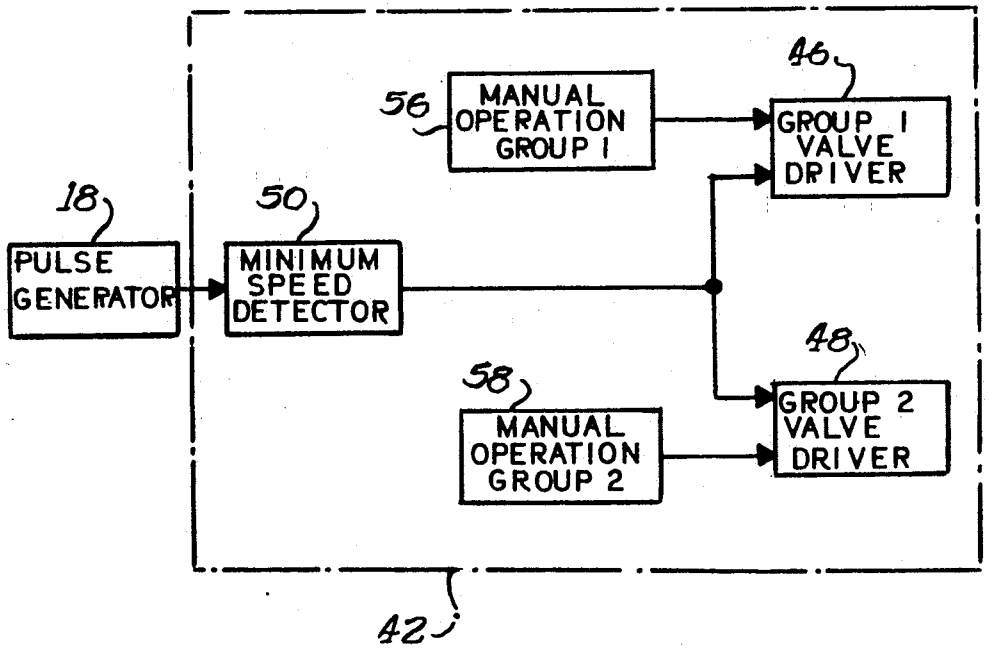
FIG. 2 is a functional block diagram illustrating operation of the improvements according to the invention.
Figure 3:
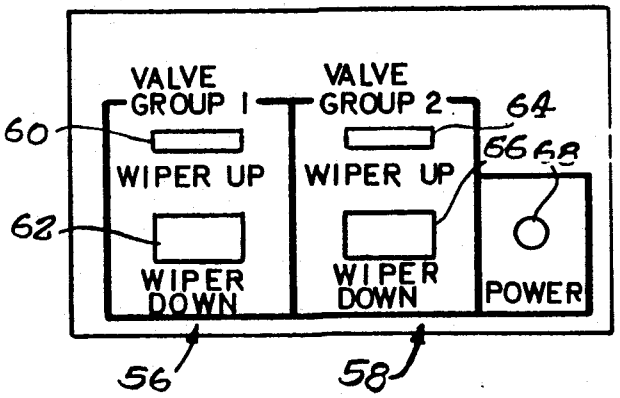
FIG. 3 is a view of a control panel which may be utilized with the improved apparatus of the invention.

Referring now to FIG. 3, the control circuit or means 42 includes a minimum speed detector circuit 50 responsive to a predetermined threshold rate of the pulses produced by pulse generator 18 for advancing and retracting the wiper 32 in the fashion described above. A valve driver circuit 46 for a first group of valves and similar valve driver circuit 48 for a second group of valves are responsive to this minimum speed detector for respectively opening and closing the valves to deliver air to and remove the air supply from respective cylinders such as the cylinder 40 as previously described. In accordance with the preferred embodiment illustrated herein, further manual override controls 56 and 58 are respectively associated with the valve drivers 46 and 48 for overriding normal operation of minimum speed detector 50 to advance and retract the wiper manually if desired. Referring briefly to FIG. 2, a control panel includes suitable wiper up and wiper down buttoned for the two groups of valves here designated as valve group 1 and valve group 2 to provide the manual override function. The respective wiper up and wiper down control switches or push-buttons for valve group 1 are designated by reference numerals 60 and 62 while those for valve group 2 are designated respectively by reference numerals 64 and 66.

Figure 7:
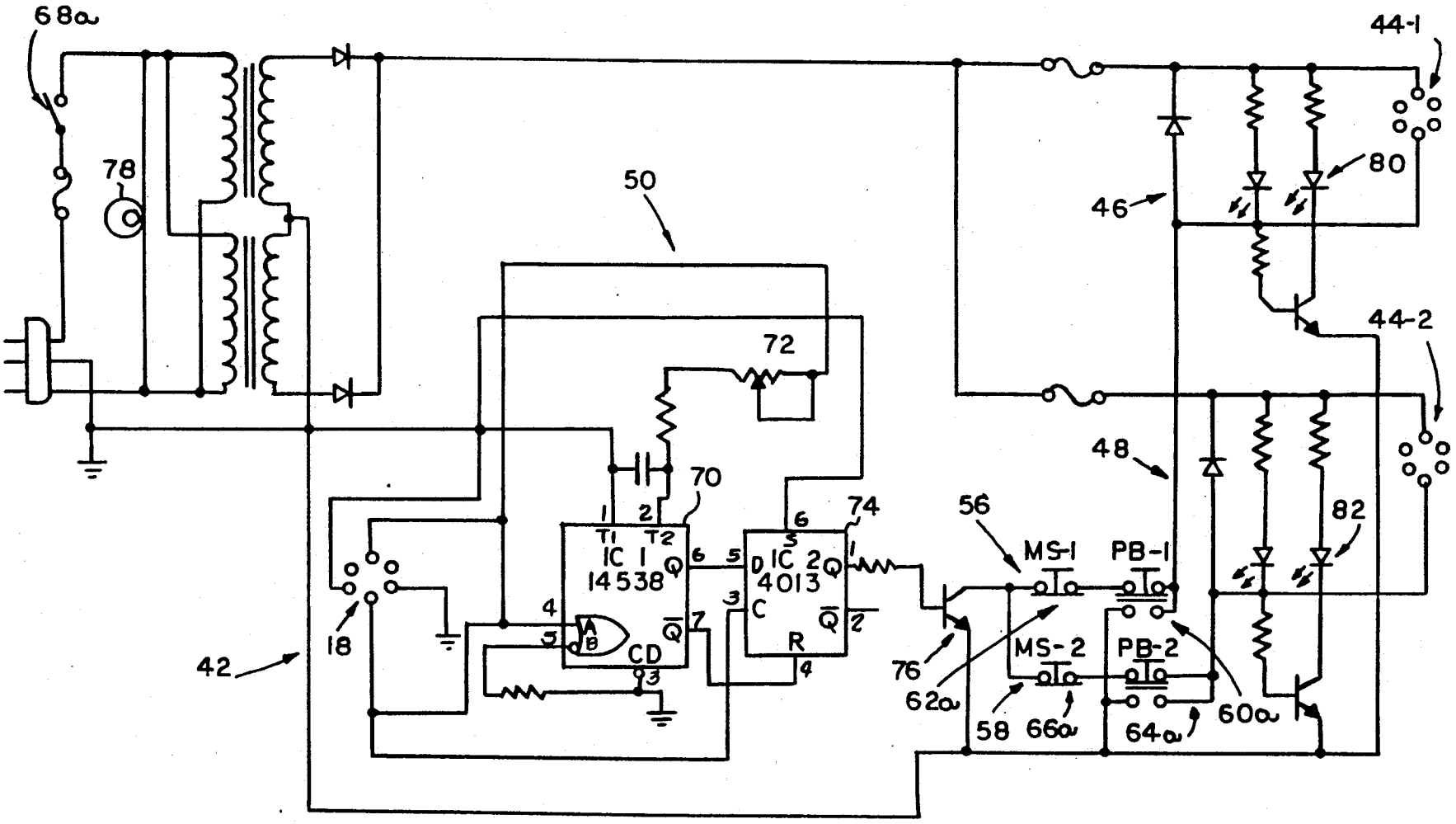
FIG. 7 is a schematic circuit diagram of a control circuit useful with the present invention.

Referring now to FIG. 7, the reference numerals 60*a*, 62*a* and 64*a*, 66*a* are utilized to designate the electrical switch components operated by the similarly-designated button actuators of FIG. 2. A power control switch 68 is also illustrated in both FIGS. 2 and 7. In operation, the air valve 44 is a normally closed type of valve, such that in the absence of a control signal from the control circuits 42, compressed air is withheld from the spring-loaded piston and cylinder 40, which maintains the wiper 32 in its advanced position for contacting and wiping the outlet 14. However, above the threshold conveyor speed, a control signal is generated by circuit 42 for delivering compressed air to the cylinder 40 and thereby retracting the wiper 32. Thus, the wiper 32 is held in a retracted position when speed of the conveyor 12 and workpiece 10 is above the preselected threshold speed at which wiper contact with outlet 14 is appropriate as discussed hereinabove. Accordingly, and turning now to the circuit diagram of FIG. 7, the minimum speed detector circuit 50 includes a monostable integrated circuit component 70 which has an RC time constant which is selectively controllable by adjustment of a variable resistor or potentiometer 72 in circuit therewith. This monostable 70 drives an RS flip-flop integrated circuit component 74 which is coupled with the base of a current control or switching transistor 76. Transistor 76 is coupled in a current-sinking configuration with the current supply to the drivers 46, 48 for the respective groups of valves such as valve 44.

In operation, when the pulse rate from the sensor 18 is sufficient to provide pulses within the RC time constant selected by the potentiometer 72, the monostable 70 and flip-flop 74 maintain a control current at the base of transistor 76, whereby the same sinks current through the valve drives to supply air to the respective valves 44. Hence, air is supplied to the cylinder 40 maintaining the wiper member 32 in its retracted position.

If the frequency of the pulses produced by the tachometer pulse generator 18 fall below the rate at which pulses are supplied within the RC time constant selected at potentiometer 72, the transistor 76 will be turned off, and the air supply will be removed from cylinder 40 by valve 44, thus causing the wiper 32 to return to its extended position, covering or wiping the outlet 14. It will be appreciated that adjustment of variable resistor 72 in effect adjusts or selects the threshold value of the frequency of pulses and hence the threshold value of speed of conveyor 12 at which the tip wiper 32 will be extended.

The previously mentioned manual override switches 60*a*, 62*a* and 64*a*, 66*a* are in circuit between the drive transistor 76 and the respective valves 44 such that they may be depressed out of the "non-actuated" positions illustrated in FIG. 7 to manually override the operation under control of minimum speed detector circuit 50 as described above. The "wiper down" switches 62*a*, 66*a* are momentary switches (MS-1, MS-2) such that the corresponding wipers will only be held advanced to contact their associated outlets while these switches are being held down. The "wiper-up" switches 60*a* and 64*a* are push-button, or push-push switches (PB-1, PB-2), and when pushed hold the corresponding wipers retracted until pushed again. The respective buttons 60, 62 and 64, 66 illustrated in FIG. 2 may be further illuminated by suitable means such as LED's generally designated by reference numerals 80 and 82 which are coupled in circuit with the respective corresponding switches 60*a*, 62*a* and 64*a*, 66*a* to illuminate any actuated one of the associated buttons 60, 62 and 64, 66. The power switch 68 may also be illuminated when actuated by a corresponding lamp 78 in circuit therewith.

Figure 6:
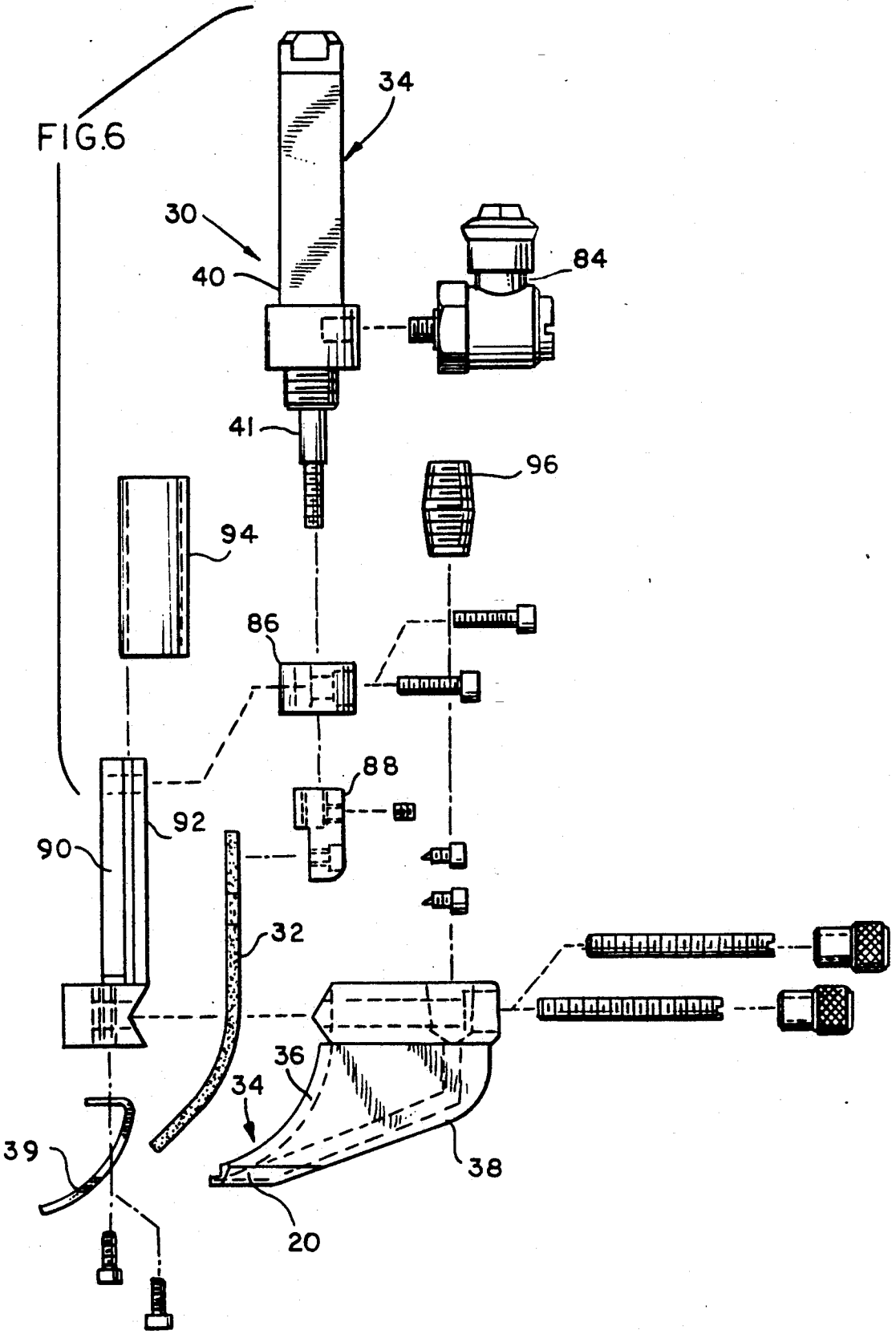
FIG. 6 is an exploded view of the apparatus of FIG. 4.

Referring briefly to FIG. 6, further details of the mechanical components making up the combined anti-tailing air nozzle and wiper assembly in accordance with the preferred embodiment of the invention illustrated herein are shown. These mechanical components include an elbow connector or fitting 84 which directs air from valve 44 to the piston and cylinder 40 and an air cylinder mounting block 86. A felt clamp clevis 88 serves to clamp the felt or wiper pad 32 to a projecting piston member 41 of piston and cylinder 40. A wiper base 90 forms a further channel 92 through which an upper portion of wiper 32 slides in operation. A top guard 94 fits around the components joined by block 88 and extends from clevis 86 to the block or body 38. Additional fasteners for coupling together these components are also illustrated in FIG. 6, together with a suitable fitting or nipple 96 for delivering compressed air to nozzle 20. Most of the fasteners are provided in pairs for fastening respective components together at two points, the second such point being located behind the plane of FIG. 6.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

We claim:

1. An improvement in a coating system including dispensing means having at least one coating outlet for delivering a coating material to a surface of a moving workpiece to which coating is to be applied in a desired pattern, and dispensing control means for producing control signals in a predetermined fashion for initiating and terminating the release of coating material to said outlet, said improvement comprising: outlet cleaning means including a wiping member selectively advanceable and retractable relative to said coating outlet between at least a first position wherein said wiping member completely covers said outlet and a second position wherein said wiping member does not cover or obstruct any part of said outlet, and cleaning control means responsive to said control signals from said dispensing control means for advancing and retracting said wiping member between said first and second positions in a predetermined fashion in accordance with said control signals; wherein said dispensing control means includes means for generating pulse signals comprising said control signals and having a frequency related in a predetermined fashion to the linear velocity of said workpiece relative to said outlet, wherein said cleaning control means includes drive means for driving said wiping member between said first and second positions for advancing said wiping member to said second position in response to the frequency of said pulse signals crossing a predetermined threshold frequency; and wherein said wiping member comprises an elongate flexible pad member; said cleaning means further including elongate guide means with a channel for slidably mounting said pad member for slidable movement between said first position and said second position.

2. The improvement according to claim 1 wherein said drive means comprises a fluid-operated piston-and-cylinder means; and wherein said cleaning control means further comprises a fluid valve responsive to said control signals for selectively controlling fluid flow to said cylinder means for advancing and retracting said flexible pad member, respectively.

3. The improvement according to claim 1 wherein said wiping member comprises an elongate strip of felt coated with oil.

4. Apparatus according to claim 1 wherein said cleaning control means further include means for selecting and for selectively varying said predetermined threshold frequency.

5. Apparatus according to claim 1 wherein said generating means generates pulse signals at a frequency directly proportional to said linear velocity of said workpiece relative to said outlet, and wherein said cleaning control means is responsive to the frequency of said pulse signal being below a given frequency, corresponding to a given minimum speed of said workpiece relative to said outlet, for advancing said wiping member relative to said outlet.

6. The improvement according to claim 1 wherein said cleaning control means further includes selectively actuatable override means for actuating said wiping member to wipe excess coating from said outlet irrespective of said control signals.

7. Apparatus for applying a coating to a surface of a moving workpiece comprising a coating dispenser having at least one outlet spaced in juxtaposition to said workpiece for dispensing a stream of coating to said surface as it traverses the coating outlet, and a dispensing control operatively coupled for initiating and terminating the release of coating material to said coating outlet in a predetermined fashion; and outlet cleaning apparatus including a wiping member selectively advanceable and retractable relative to said coating outlet between at least a first position wherein said wiping member completely covers said outlet and a second position wherein said wiping member does not cover or obstruct any part of said outlet, and a cleaning control responsive to predetermined control signals from said dispensing control for advancing and retracting said wiping member between said first and second positions in a predetermined fashion in accordance with said control signals; wherein said dispensing control includes means for generating pulse signals comprising said control signals and having a frequency related in a predetermined fashion to the linear velocity of said workpiece relative to said outlet, wherein said cleaning control includes drive means for driving said wiping member between said first and second positions for advancing said wiping member to said second position in response to the frequency of said pulse signals crossing a predetermined threshold frequency; and wherein said wiping member comprises an elongate flexible pad member; said cleaning apparatus further including elongate guide means with a channel for slidably mounting said pad member for slidable movement between said first position and said second position.

8. Apparatus for applying a glue bead to a moving surface of a workpiece and comprising: glue dispensing means having at least one glue outlet spaced in juxtaposition to said moving workpiece surface, dispensing control means operatively coupled for initiating and terminating the release of glue to said glue outlet; outlet cleaning means including a wiping member selectively advanceable and retractable relative to said glue outlet between at least a first position wherein said wiping member completely covers said outlet and a second position wherein said wiping member does not cover or obstruct any part of said outlet, and cleaning control means responsive to predetermined control signals from said dispensing control means for advancing and retracting said wiping member between said first and second positions in a predetermined fashion in accordance with said control signals; wherein said dispensing control means includes means for generating pulse signals comprising said control signals and having a frequency related in a predetermined fashion to the linear velocity of said moving surface of said workpiece relative to said outlet, wherein said cleaning control means includes drive means for driving said wiping member between said first and second positions for advancing said wiping member to said second position in response to the frequency of said pulse signals crossing a predetermined threshold frequency; and wherein said wiping member comprises an elongate flexible pad member; said cleaning means further including elongate guide means with a channel for slidably mounting said pad member for slidable movement between said first position and said second position.

9. An improvement in a coating system including coating dispensing means having at least one coating outlet for delivering a coating material to a surface of a moving workpiece to which coating is to be applied in a desired pattern, and dispensing control means for producing control signals in a predetermined fashion for initiating and terminating the release of coating material to said outlet, said improvement comprising: a pad member selectively advanceable and retractable relative to said coating outlet between at least a first position wherein said pad member completely covers said outlet and a second position wherein said pad member does not cover or obstruct any part of said outlet; cleaning control means responsive to said control signals from said dispensing control means for alternatively advancing and retracting said pad member to said first position for completely covering said coating outlet, and to said second position for uncovering said coating outlet to permit dispensing of coating in a predetermined fashion in accordance with said control signals; wherein said dispensing control means includes means for generating pulse signals comprising said control signals and having a frequency related in a predetermined fashion to the linear velocity of said workpiece relative to said outlet, wherein said cleaning control means includes drive means for driving said pad member between said first and second positions for advancing said pad member to said second position in response to the frequency of said pulse signals crossing a predetermined threshold frequency; and wherein said pad member comprises an elongate flexible member; said cleaning means further including elongate guide means with a channel for slidably mounting said pad member for slidable movement between said first position and said second position.

* * * * *